United States Patent [19]

Kieckhefer et al.

[11] 4,172,165

[45] Oct. 23, 1979

[54] DIFFERENTIALLY TRANSVERSELY KNIT PILE FABRIC

[75] Inventors: Guy N. Kieckhefer, Waukesha; Brady T. Grubbs, Whitewater, both of Wis.

[73] Assignee: Borg Textile Corporation, Oak Brook, Ill.

[21] Appl. No.: 911,422

[22] Filed: Jun. 1, 1978

[51] Int. Cl.[2] ..... B32B 3/02

[52] U.S. Cl. ..... 428/92; 66/32; 66/51; 428/94; 428/95; 428/96; 428/253; 428/254

[58] Field of Search ..... 428/92, 94, 95, 96, 428/253, 254; 66/8, 32, 50 R, 51, 76, 194, 197, 200; 26/7, 10.4

[56] References Cited

U.S. PATENT DOCUMENTS 3,948,722 4/1976 Wheeldon ..... 428/254

4,051,287 9/1977 Hayashi ..... 428/253

*Primary Examiner*—Marion E. McCamish

*Attorney, Agent, or Firm*—Hill, Van Santen, Steadman, Chiara & Simpson

[57] ABSTRACT

A differentially transversely knit pile fabric is provided which is adapted to experience non-linear stretching in a transverse direction, and, when so stretched, longitudinally extending patterns therein which have been differentially knitted in a compensating manner become distorted so as to be of standardized or predetermined widths relative to one another. Preferably, such fabric after typically being knitted on a circular knitting machine is slit into a sheet form and then is stabilized by application to the backing thereof of a coating composition. After being stabilized with the aid of such a stabilizing composition coated thereon, the product fabric is capable of retaining its dimensional integrity.

11 Claims, 10 Drawing Figures

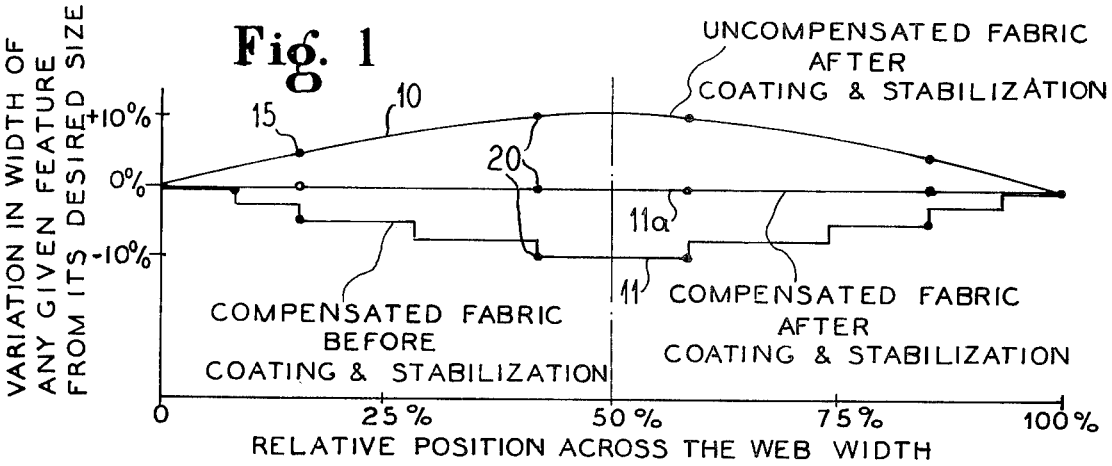
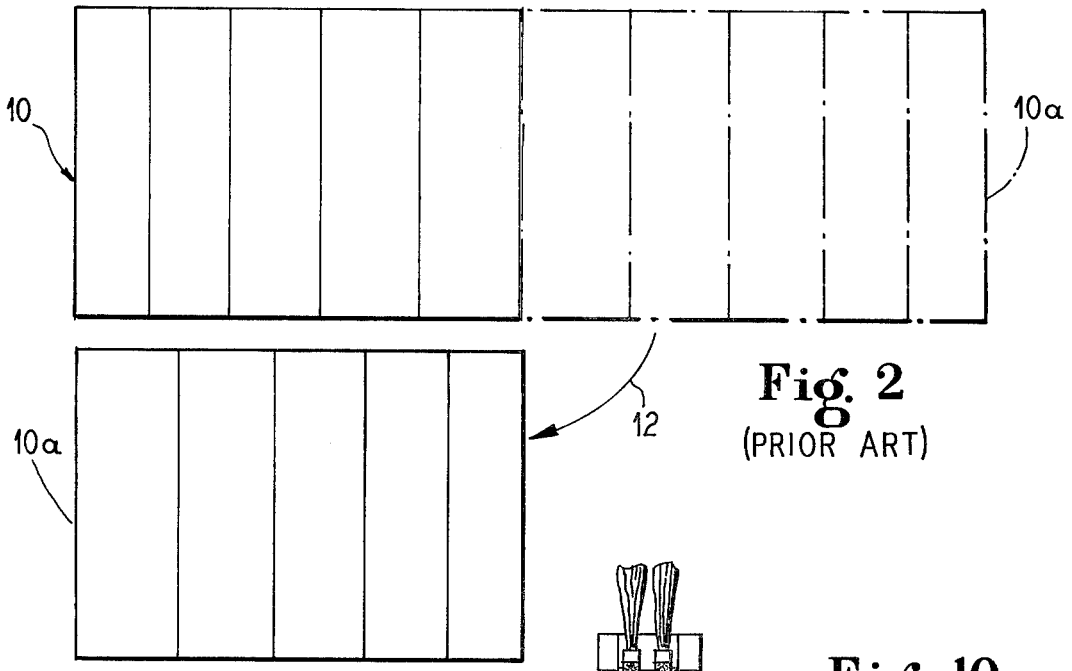
Fig. 2
(PRIOR ART)
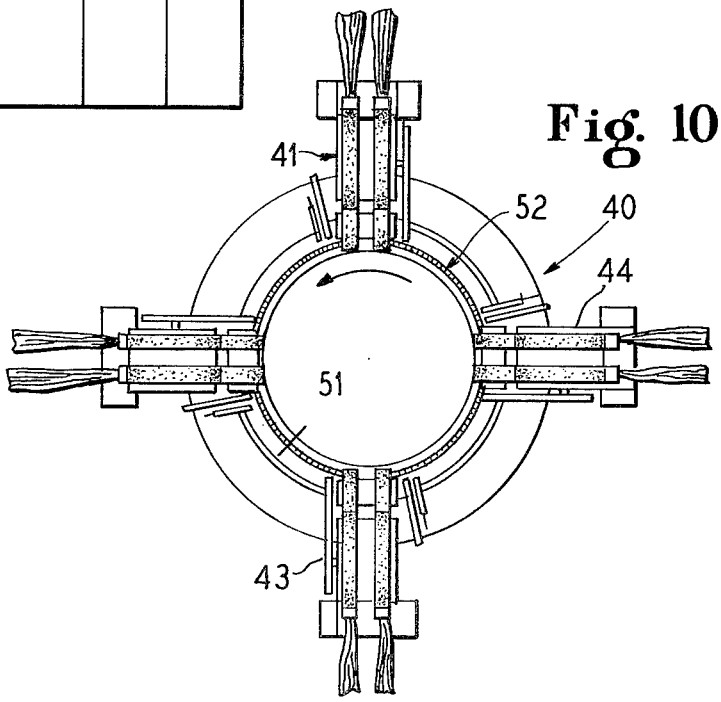
Fig. 10

DIFFERENTIALLY TRANSVERSELY KNIT PILE FABRIC

BACKGROUND OF THE INVENTION

In the art of circular knitting, it has been found that product fabrics as knitted and slit to form sheet goods characteristically display when transversely stretched a tendency to experience greater elongation transversely in central regions thereof than in side regions thereof. This problem is severe in the case of longitudinally patterned fabrics, particularly fabrics having a pattern repeat which is intended to be of constant width from pattern to pattern. So far as is known, the exact reason why such a differential transverse stretch characteristic occurs is unknown. Also, so far as is known, no means or technique is known for overcoming such characteristic so as to produce a sliver knit pile fabric having a longitudinally extending pattern which can be transversely expanded or stretched to a controlled extent without distoring the desired dimensional characteristics, particularly width characteristics, of the pattern formed in the fabric.

BRIEF SUMMARY OF THE INVENTION

In one aspect, the present invention provides a sliver knit pile fabric product which is differentially knitted in the transverse direction relative to a longitudinally extending pattern. In its initially knit condition, and before undergoing any stabilization, this fabric product in its relaxed state characteristically has a greater number of wales per transverse pattern unit of width in its edge portions than it does in its central portions. The variation in wales from the central region to a side edge region of such a fabric product is controlled in such a manner that when such knitted product is subsequently transversely elongated or stretched and is then stabilized as through application of a coating composition to the backing thereof there results a final product with a uniform pattern repeat width.

In another aspect, the present invention provides a process for knitting such a fabric product.

In another aspect, the present invention provides a technique for stabilizing such a knitted fabric product in a transversely stretched configuration.

Other and further features, objects, purposes, advantages, aims, utilities and the like will be apparent to those skilled in the art from a reading of the present specification taken together with the drawings.

BRIEF DESCRIPTION OF THE DRAWINGS

In the drawings:

FIG. 1 is a graphic plot showing a comparison of a sliver knit pile fabric of the prior art and a sliver knit pile fabric of the present invention as regards their respective transverse stretching characteristics;

FIG. 2 is a plan view of a conventionally stabilized prior art high pile sliver knit fabric illustrating problems in pattern registration characteristic thereof;

FIG. 10 is a fragmentary diagrammatic top plan view of one embodiment of a circular knitting machine which has been adapted to differentially knit a fabric construction of the present invention using either one or the other of the systems shown in FIGS. 8 and 9, respectively.

DETAILED DESCRIPTION

Figure 3:
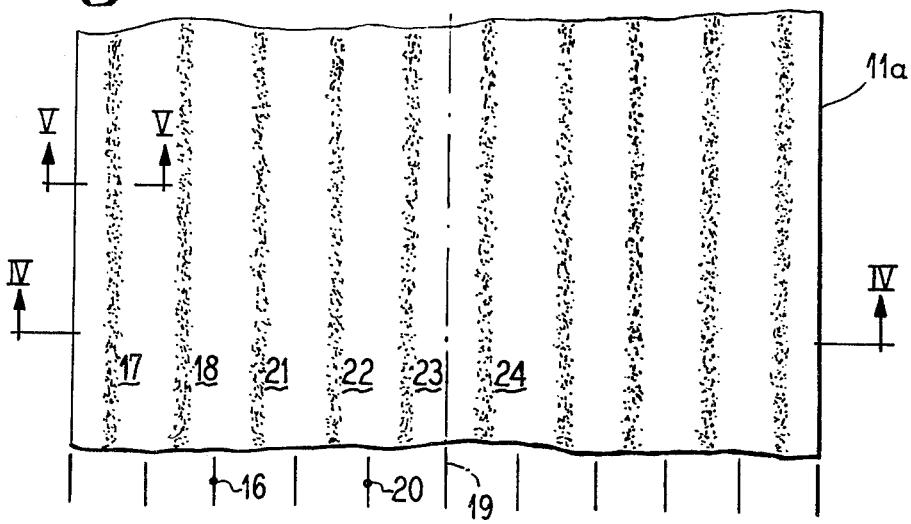
FIG. 3 is a plan view of a differentially knitted sliver knit high pile fabric illustrating one embodiment of the present invention such embodiment having pattern repeats of constant width longitudinally extending therein.

The present invention provides an improved sliver knit pile fabric which has been dimensionally stabilized. Herein, the fabric is tensioned both transversely and longitudinally to an extent sufficient to expand the length thereof from 0 to about 30% and to expand the width thereof from about −30 to +30%. Thereafter the tensioned fabric is back coated with a stabilizing liquid coating composition, and then heated to dry the coating composition and bond same to the fabric back. The sliver knit pile typically having from about 8 to 24 wales per inch and from about 17 to 42 courses per inch with a transverse width as knitted on a circular knitting machine after longitudinally slitting of from about 36 to 90 inches. The backing structure of the fabric consists of yarn commonly having a denier ranging from about 156 to 600 with the piie thereof incorporating a plurality of longitudinally extending, transversely repeating patterns. Each of the patterns incorporates from about 10 wales up to a number of wales not greater than about $\frac{1}{3}$ of the total number of wales comprising the transverse width of said fabric.

Referring to FIG. 1, there is seen a graphical analysis wherein points on the abscissa represent the width of each of a prior art sliver knit pile fabric, which is designated in its entirety by the numeral 10 and a sliver knit pile fabric of the present invention which is designated by the numerals 11 and 11*a*. Points along the ordinant for this plot represent variation in stretch across the width of such a fabric. Fabric 10 is conventionally knitted on a circular knitting machine and then slit; it has in its relaxed state before stabilization a constant number of wales per transverse unit of width proceeding from one edge across to the other edge thereof. When this fabric 10 is stretched and stabilized by applying a coating to its backing and then drying the stabilizing coating it is found that there is a distortion in the pattern repeat thereof so that at any given point the characteristic appearance thereof is shown in FIG. 1 by the relative distance of the curved line designated by the numeral 10 is above the central line which is here designated by the numeral 11*a*.

Referring to FIG. 2 there is seen a principle consequence of such distortion of the fabric 10. In FIG. 2 there is shown a striped fabric of the prior art type shown in FIG. 1 and designated as 10. Here, the fabric 10 has been slit longitudinally at its center and the two pieces are placed end to end without rotating either piece as might be desired in an actual use situation where one desires to have a continuous length of fabric with pile laying in a common direction for some end use application. Because of the distortion as shown by the variations in the pattern, a user might first endeavour to turn one half say half 10*a* end for end so as to achieve a matching of the longitudinal patterns. However, this is not practical since the nap of the pile shades if the nap extends in one direction for one half and a different direction for the other half of the two pieces. In other words, a noticeable difference in the appearance of the product composite structure is seen relative to one half in comparison to the other thereof. Thus, it is necessary to simply move half 10*a* from its upper position in FIG. 2 into its lower position as shown by the arrow translation line 12. However, when the fabric is so moved it is seen that it is not possible to line up or align the individual pattern repeats with one another owing to the differential stretch characteristics above described. On any piece of a given knitted fabric the distortion pattern is substantially the same. Even different styles of knitted fabrics appear to have a similar distortion pattern.

To compensate for these problems and to overcome the problem of differential stretch, a fabric such as fabric 11 (refer to FIG. 1) is provided. Here, a fabric is knit upon a circular knitting machine in such a way that there is a larger number of wales per transverse pattern unit near the side edge portions thereof than in the central portion thereof.

Line 11 in FIG. 1 represents a plot showing the manner in which a fabric of this invention is knitted. Line 11*a* in FIG. 1 shows the desired appearance of the product after knitting, and stabilization (as by back coating and heating). Line 11*a* represents a stabilized but transversely stretched product of the present invention wherein the individual pattern repeats have constant widths relative to one another transversely so that there is no dimensional variation from one pattern to another transversely thereacross.

As those skilled in the art will appreciate, in any given prior art sliver knit pile fabric, the extent of the distortion or excessive elongation occurring in the mid portion of a fabric compared to the opposed side edge portions thereof is determinable. Characteristically, this variation falls in the range of from about 1% to 20%.

Referring to FIG. 1, in the practice of the present invention, one determines the extent of distortion in a first side edge pattern existing in a conventionally knit fabric holding a pattern that is desired. As for example at point 15 one would observe that there is a dimensional variation transversely equal to one stitch (or wale) approximately, for illustration purposes. Such a point is not necessarily where the pattern repeat will occur. Thus, as the number of wales transversely reaches a point where pattern width is distorted by an amount equal to one wale a wale is added to or subtracted from a given pattern so that in the stabilized stretched configuration each pattern width is substantially equal to all others thereof in a given fabric.

The stair step arrangement associated with line 11 in FIG. 1 attempts to illustrate the number of wales in each segment of a differentially knitted fabric produced in accordance with the present invention. In other words, as one knits a fabric by the practice of the present invention, the individual number of wales is varied systematically for each of selected ones of a series of transverse fabric width portions. The wale variations in such selected width portions is determined by the transverse distortions that inherently occur in the fabric transversely when the fabric is stretched, back coated, and stabilized all in accordance with knitted fabric stabilizing procedures. There is a continuous variation characteristically in individual wale size proceeding from the center of a stabilized, knitted fabric transversely outwardly. By the present invention, because of these variations, there are introduced periodic regions transversely into a product fabric wherein the number of wales per unit of pattern(s) is varied such that when going from the center toward either side edge of the fabric the number of wales will go up and when going from either side edge toward the center of the fabric the number of wales per pattern repeat goes down.

FIG. 3 shows a stabilized differentially knitted sliver knit pile fabric of the present invention. Here, the pattern repeat in the fabric comprises stripes, but those skilled in the art will appreciate that the pattern can be very complex. The distance transversely between successive stripes is here substantially equal. The illustrative stitch pattern is variable transversely in the fabric of FIG. 3 from pattern repeat to pattern repeat in accordance with the description above provided in reference to FIG. 1. For example, a point 15 in FIG. 1 may correspond to a point 16 in FIG. 3. Thus, there is a constant number of wales per pattern in pattern repeat 17 and 18 up to the point in pattern 18 where point 16 is reached. Following this point, and proceeding inwards towards the center line 19, the number of wales is reduced by a value of 1 when one reaches the point 20.

Figure 4:
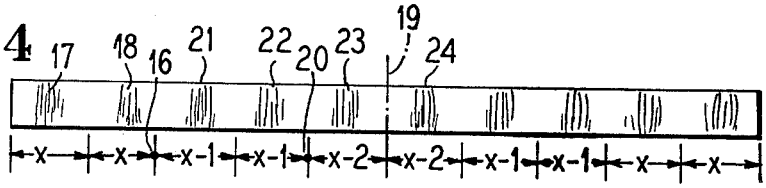
FIG. 4 is a vertical sectional view taken along the line IV—IV of FIG. 3.
Figure 5:
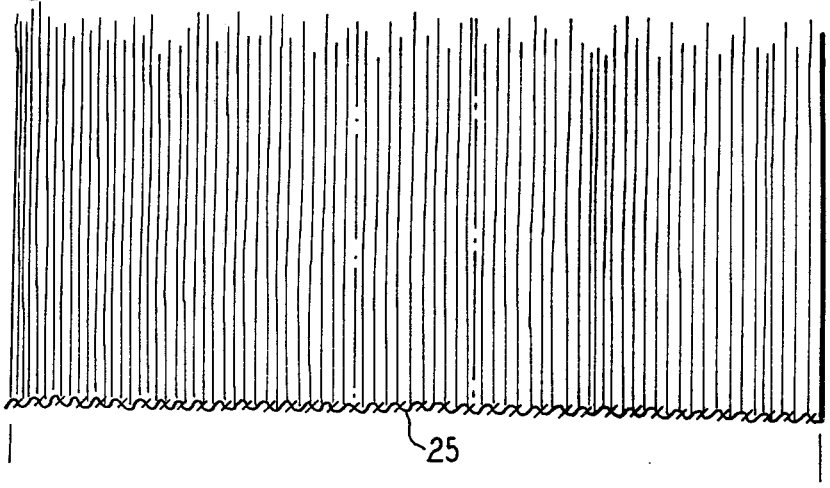
FIG. 5 is a greatly enlarged fragmentary view of one pattern repeat section taken along the line V—V of FIG. 3.

Referring to FIG. 4, the interrelationship between wales and pattern repeats is further illustrated. In this example, two pattern repeats 17 and 18 each have the same number of wales transversely. The next inwardly adjacent pattern repeat 21, however, has one less wale in its transverse width than does either of the pattern repeats 17 and 18, which is also true of the pattern repeat inwardly adjacent thereto identified as pattern repeat 22. The innermost pair of pattern repeats 23 and 24, in this illustration, are located one on each side of the center line 19, and here the number of wales in each of the pattern repeats 23 and 24 is one less than that in each of these adjacent pattern repeats 21 and 22.

Fabric constructions of the present invention as illustrated are bilaterally symmetrical so that the sequence on the left side of the fabric depicted in FIGS. 3 and 4 is the same as that on the right side of the center line 19 thereof. It is not, however, necessary that either the patterns or their relative locations be symmetrical, as those skilled in the art will appreciate.

Figure 6:
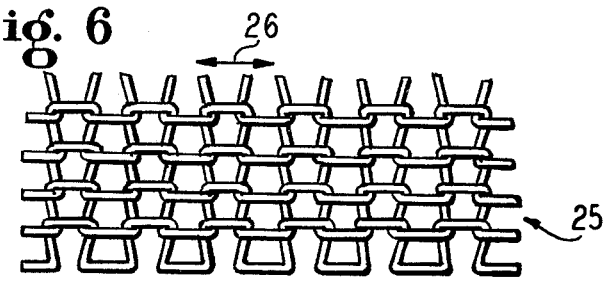
FIG. 6 is a top view of the knit structure of the fabric backing yarn of FIG. 3 in greatly enlarged diagrammatic form.

As can be seen from FIG. 6, the backing in a sliver knit pile fabric, the backing being here designated illustratively in its entirety by the numeral 25, is seen to have the characteristic capacity to stretch both transversely and longitudinally, which is, for example, contrary to the situation existing in a conventionally woven fabric. The individual wales 25 are formed of substantially uniformly sized loops of yarn which are not individually constrained by geometric considerations in their ability to be collectively distorted and even elongated in a transverse direction as represented by the arrow 26.

The differentially knit pile fabrics of the present invention make possible a variety of new and unusual sliver knit pile fabrics which previously were not available to the prior art. Heretofore, the distortions between side edge portions and central portions characteristically found in stabilized knitted fabrics limited the end use of such fabrics to situations where such distortions were not objectionable. Thus, for example, a differentially knit pile fabric of the present invention can be comprised of backing members and pile fiber members which are longitudinally stable as respects both their physical elongation characteristics as well as their heat stability characteristics.

A product differentially knit fabric is then tensioned longitudinally and transversely, as on a tenter frame of the type conventionally known to the art of knit fabric processing. Positive transverse tensions in knitted fabrics can be characteristically achieved without transverse elongations by applying positive longitudinal tensions, as those skilled in the art will appreciate. Therefore, while in any given stabilized fabric product of this invention the differentially knitted fabric is under a positive transverse tension before it is back coated with a stabilized coating composition, after the coated coating composition has been processed, as by heat, to produce such a stabilized fabric product, such stabilized fabric product may not be transversely elongated over its starting width. Even in cases where the stabilized width is the same as the starting width transverse distortions do occur which are overcome by the practice of this invention. Such tensioning may increase or decrease the transverse width of a knitted fabric over its relaxed or starting configuration by a percent of elongation which can vary from about ±30%. Such tensioning may increase the longitudinal length of such a knitted fabric up to about 30% elongation. In any given knitted fabric which has been differentially knitted by the teachings of this invention, the precent elongation transversely is always such as to produce a product fabric having a predetermined width.

Typically, prior to such transverse stretching, the fabric is longitudinally stretched as a means for controlling movement of the fabric beneath the coating apparatus. After being so longitudinally and transversely stretched, the product fabric is moved past a coating apparatus so as to have a coating applied to the exposed face of the backing thereof. Many different backing compositions are known to the art, as are techniques for stabilizing knitted fabrics. Conventional, previously known knitted fabric stabilizing technology can be used in processing differentially knitted fabrics of this invention.

After the back coating has been applied, and while the fabric is still stretched both transversely and longitudinally, the resulting so back coated fabric is typically subjected to a heating operation to dry and bond the coating composition to the backing. The temperatures of heating is, of course, variable depending upon many factors. Thus, typically, the amount of heat applied is always sufficient to cause the evaporation of any liquid carrier used in the application of the coating. Commonly, if the coating composition is of the type which develops strength upon heating, the amount of heat used is sufficient to develop the degree of bonding action or strengthening action characteristic of that coating composition. The sequence of back coating followed by heating applied to this fabric, identified as A, can be regarded as one of the conventional type heretofore used in the art of stabilizing sliver knit pile fabrics, as those skilled in the art will appreciate.

After the heating or other processing operation is completed, the resulting knit fabric is removed from the tensioning means, such as a tenter frame, and the fabric does not revert to its starting, non-tensioned state, though some (typically negligible) shrinkage may occur. This product fabric is thus a dimensionally stabilized knit pile fabric which can be subjected to a shearing operation or otherwise, as desired. Typically, a shearing is accomplished by continuously moving the stabilized fabric past a shearing zone operating transversely to the direction of longitudinal movement of the pile being sheared. Typically, such a shearing is accomplished uniformly across the pile of the fabric. Some longitudinal tensioning may be applied during the shearing.

After being sheared the resulting fabric is typically tensioned to an extent sufficient to pass it through an electrifier. Suitable electrifiers are known to the prior art; see, for example, U.S. Pat. Nos. 2,934,809; 3,114,957; and 3,119,603.

The electrifier may remove some kinking present in the pile of the fabric and also the electrifier depending upon the settings and type of electrifier used aids in polishing the individual pile fibers.

Thereafter the resulting electrified or electrifier treated sliver knit pile fabric is subjected to a shearing operation in which to remove any extended or wild fibers projecting from the surface of the pile thereof. As is typical of the action of an electrifier, some of the fibers in the pile are extended during the electrifier operation.

Figure 7:
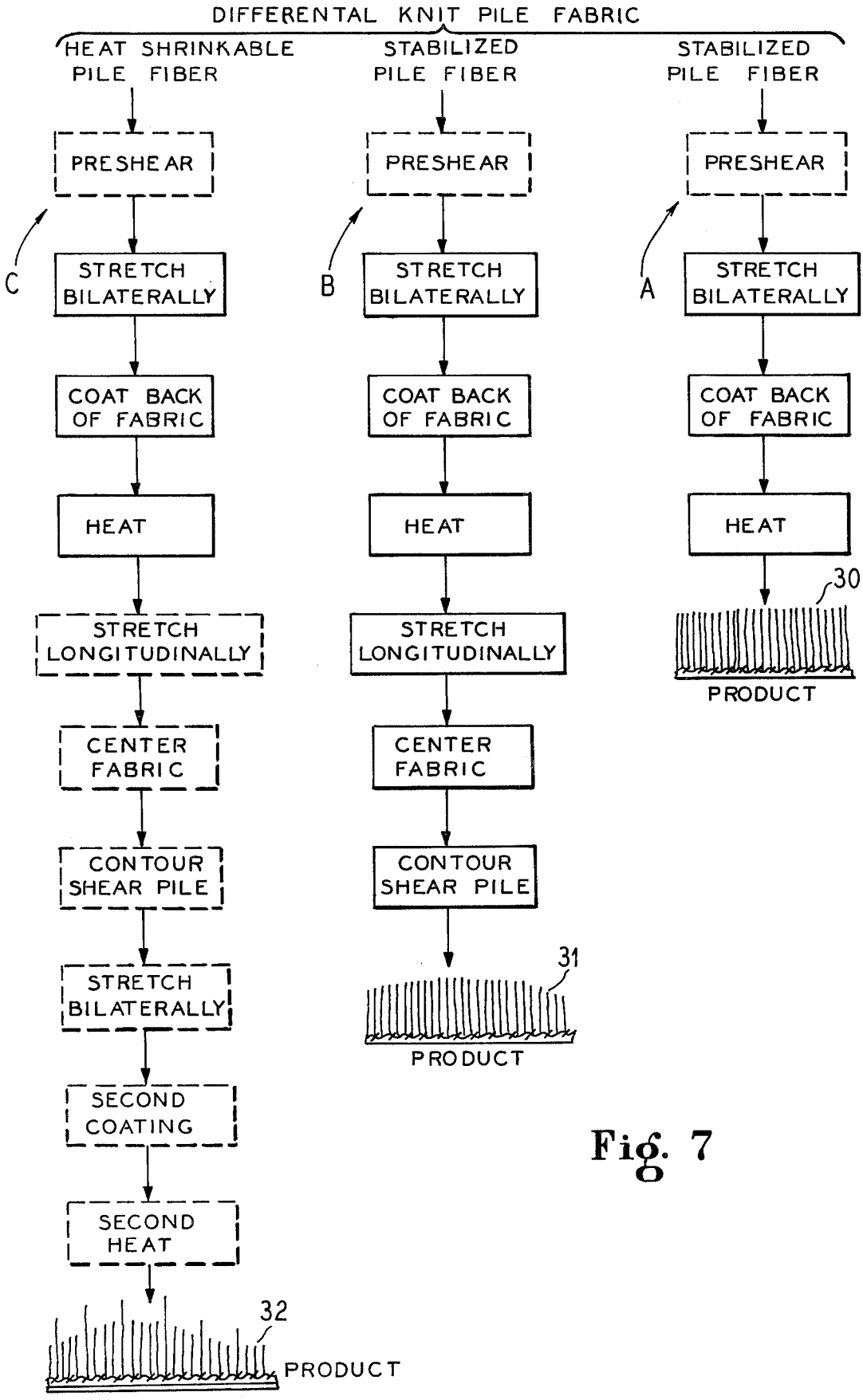
FIG. 7 is a flow diagram illustrating three different techniques for processing a differentially knit pile fabric produced in accordance with the practice of the present invention.

Typically and preferably a second and final electrifier passage is carried out upon a product so that the final fabric goods produced are represented by the diagram identified by the number 30 of FIG. 7. In accordance with the teachings of the present invention, the product 30 can be a striped fabric, or the like, suitable for use in upholstery, apparel, or other applications where striped fabric goods (or equivalent, as regards a pattern repeat) are conventionally employed.

Referring again to FIG. 7, there is seen another class of differentially knitted pile fabric within the teachings of the present invention, such being herein referred to by the letter B in FIG. 7. Here a stabilized backing yarn and a stabilized pile fiber are also used from the standpoint of elongation characteristics and thermal stability characteristics. This fabric can be considered to be identical if desired, to the fabric A above. Here, however, the fabric B is processed somewhat differently. Thus, after being back coated and heated to stabilize the fabric dimensionally, the resulting stabilized fabric is subjected to a contour shearing operation of the pile thereof. While being contour sheared, the fabric is longitudinally stretched and transversely centered relative to the transversely extending contour shearing apparatus, the fabric being continuously moved longitudinally beneath the transversely extending contour shearing apparatus. The contour shearing operation is matched to the pattern in the fabric. Suitable contour shearing apparatus is provided by the teachings of Abler U.S. patent application Ser. No. 719,017, filed Aug. 30, 1976.

After being contour sheared, the product fabric can be subjected to a series of finishing operations similar to those above described in reference to the fabric A and as illustrated in FIG. 7 by an alternate sequence of electrification followed by conventional transverse shearing, and then finally followed by a terminal electrification step, or the like, as desired.

The product 31 is seen to have a contoured surface as diagrammatically indicated.

Still another type of product which can be prepared from a differentially knit pile fabric of the present invention is shown in FIG. 7 as being derived from a starting fabric which is herein designated by the letter C. Here the starting fabric C is one which incorporates in its pile heat shrinkable fibers. This starting fabric is stretched in, for example, a similar manner to that used with the fabrics A and B, and then is back coated using a back coating composition which develops through subsequent heating sufficient strength to stabilize dimensionally the starting fabric without causing any substantial heat shrinkage of the heat shrinkable fiber in the pile thereof. After being so stabilized, the resulting fabric is contour sheared in a manner such as above described in reference to the fabric B.

Thereafter, the resulting contour sheared pile fabric is tensioned, as on a tenter frame, or the like, and is subjected optionally, but preferably, to a second coating operation. After such a second coating operation on the backing thereof, a final second heating step may be undertaken wherein the temperature of such heating is sufficient to accomplish both a desired longitudinal heat shrinkage of the heat shrinkable fibers in the pile of the fabric as well as a development of the maximum strength and bonding of the total back coating on the fabric (the exact strength and bonding being developable in any given case depending upon the respective compositions of such first and second coatings). The finished stabilized fabric material is then, if desired, further processed. For example, it can be tensioned and subjected to terminal processing steps, such as an electrification followed by an intervening shearing (which may or may not be a contour shearing operation, as those skilled in the art will appreciate). The final product can have a cross-sectional appearance, for example, such as is illustrated for the product 32 in FIG. 7.

Figure 8:
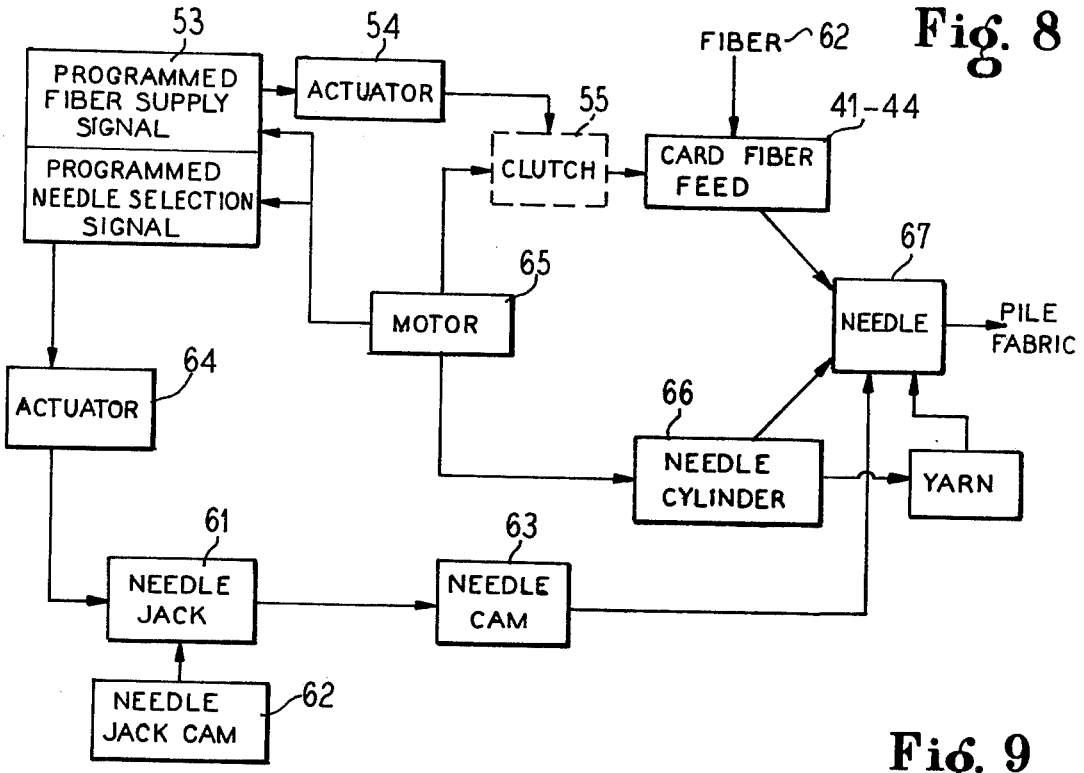
FIG. 8 is a block diagram illustrating one mode in which a differentially knit pile fabric of the present invention can be prepared upon circular knitting machines using a mechanical control system.

In order to knit on a circular knitting machine, a differentially transversely knit deep pile fabric of the present invention using a circular knitting machine 40, such as is shown in FIG. 10, it is necessary to provide such machine 40 with a system which will cause the machine to knit in the manner desired the product differentially knit fabric. Referring to FIG. 8, there is seen a mechanical system for accomplishing this operation. Here the needle cylinder of the knitting machine 40 is continuously revolving as the machine operates in a conventional manner. Cams actuate individual needles and backing yarn is knitted into a conventional sliver knit pattern. As the backing is being formed pile fiber picked up by the needles is knitted into the fabric. The pile fiber is fed into the circular knitting machine 40 via carding heads 41, 42, 43 and 44.

In order to obtain a variable fiber feed to form a pattern in the pile, the individual carding heads 41, 42, 43, and 44 may be controlled so as to feed fiber of appropriate color and the like to the needles forming the fabric circumferentially about the cylinder of the machine 40. For example, a mechanical control mechanism such as shown in U.S. Pat. No. 3,709,002 or the like can be used to control the pile fiber feed into the knitting machine 40.

The total number of stitches around such circumference of the needle cylinder is constant, for example, 750.

Referring to FIG. 10, the position 51 may be taken as the longitudinal slit location, while the position 52 may be taken as the longitudinal center location for sliver knit pile fabric being knitted on the machine 40. It may be desired to have the pattern repeats be symmetrically arranged with respect to the center 52 of the fabric being knitted. In this illustrative embodiment, one chooses to have the pattern symetrically arranged and to have the first pattern repeat have approximately 34 wales. As one moves away from the center line 52 towards a location where the center line of an individual pattern repeat occurs, the program signal device 53 optionally may cause the actuator 54 to activate the clutch 55 so that color of a predetermined fiber is selected and fed to the carding heads, such as carding heads 41 through 44, whereby the patterns are located at the designated predetermined locations in the fabric being knitted relative to the number of stitches or wales being utilized transversely in each pattern repeat. Subsequently the signal program signal device 53 by means of actuators, 64, selects needle jacks 61 which in turn select needles to be raised by the needle cam 63 allowing specific needles to select fiber 62 from specific carding head and knit fiber into specific wales corresponding with pattern requirements. As one proceeds along the pattern repeat, to the pattern repeat adjacent the center line 52, one can consider, for example, that the operation has arrived at the location 20 in FIG. 1 (by coincidence and for illustration purposes). At this location, one controls the number of wales so as to produce the desired compensating characteristics. The machine is driven and operated in such a sequence that the center line of each individual pattern repeat is located at a desired position in the circumferential scheme of the knitting operation and also appears in the right sequence and relationship to the center line 52 anticipated for a given product fabric. Motor 65, drives knitting cylinder 66, which in turn carries needles 67, and jacks 61 past jack actuators 64 and needle cams 63. The motor also drives carding heads 41–44 optionally through clutch 55. If clutch 55 is optionally not used the motor will drive carding heads 41–44 continuously.

In accordance with the general principles explained above in relation to FIG. 1 and elsewhere, as one proceeds around the needle cylinder circumferentially away from the center line 52 the individual pattern repeats become successively wider, although the width changes are characteristically incremental and relatively small in relation to the actual width of an individual pattern. The amount of width change experienced is entirely determinable, for example, by the amount of width change needed in any given case by an analysis made graphically as above explained in reference to FIG. 1. The conventional programmer signal must be pre-programmed to maintain each individual pattern repeat as it comes up to an individual carding head 41 through 44. As the area comes up relative to the pattern then the appropriate knitting and pile formation occurs so that one incorporates into a fabric being knitted the proper and desired color combination to achieve a striped pattern, or the like, as desired. The programmer signal 53 incrementally varies as required according to the pattern repeat distortions, typically occurring in an individual uncompensated fabric.

Figure 9:
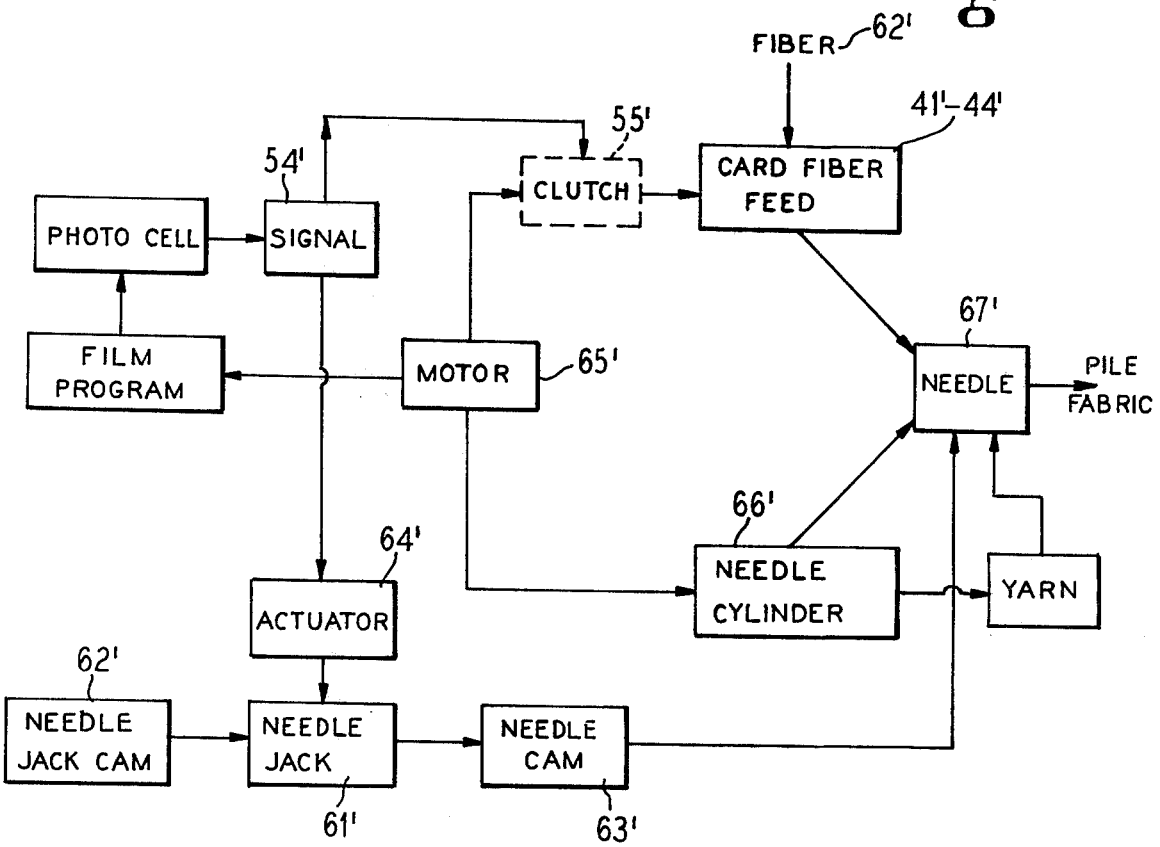
FIG. 9 is a view similar to FIG. 8 but showing an electronic control system for producing such a differentially knit pile fabric of the present invention.

FIG. 9 shows a system which performs the same functions as the system shown in FIG. 8 except that in FIG. 9 these functions are performed electromechanically. Here, a conventional programmer of the film type is incorporated into the operation of the system. A photo cell reads the film program and a signal is generated which is used to operate the clutch 55 for determining fiber feed to individual card fiber feed assemblies 41 through 44, and to select needles to take fiber selectively from card 41 through card 44. For knitting certain patterns it is not necessary to signal the clutches, to stop feeding fibers to the respective carding heads, in which knitting operations the clutches may be omitted from the system, as those skilled in the art will appreciate.

The tension distortion in a given fabric may not necessarily be symmetrical with respect to the longitudinal true center line thereof. It is a feature of the present invention that transverse differences in wales per selected incremental units of transverse fabric width whether or not exactly correlated with given pattern repeats can be incorporated into a given fabric to compensate for pattern distortion transversely in a given fabric even when the tension distortion that would otherwise be achieved in a non-differentially knitted fabric of the prior art is not symmetrical. The reason for non symmetrical distortion as opposed to symmetrical distortion patterns is not known at this time. The term "center line" as used herein thus connotes a reference line only; the term "center line" does not necessarily correspond with the location of maximum distortion in a given knitted stabilized fabric, or the like.

The number of wale variations transversely introduced into a given fabric for a particular one of several repeats is determined not by the number of pattern repeats transversely across a fabric, but rather by the distortions in wale size in that region or increment of a stabilized (tensioned) fabric at the location at which that one repeat is to be placed.

Thus, by the process of the present invention one makes knitted fabric of predetermined width having a plurality of pattern repeats each of predeterminable width and fabric location relative to others thereof. This fabric has a generally predeterminable differential transverse stretch distortion characteristic when dimensionally stabilized. This distortion characteristic is greatest along a predetermined longitudinally extending hypothetical reference line which need not be the same as the longitudinally extending hypothetical center line of said fabric.

In practicing this process, one determines as an initial step the incremental transverse wale size distortion which will exist in such a stabilized fabric between such reference line and each respective opposed side edge portion of such stabilized fabric relative thereto. Then, one assigns to each pattern repeat that number of wales which is required for incrementally achieving the desired respective width of each such pattern repeat in such stabilized fabric pattern repeat, depending upon the relative position of each such respective pattern repeat and the predetermined increment of transverse distortion at said position in such stabilized fabric between such reference line and each of such respective opposed side edge portions. Finally, one programs the control apparatus functionally associated with a knitting machine to knit a knit pile fabric wherein successive patterns on either side of said reference line contain progressively and incrementally respectively increasing numbers of wales as the distance from said center line increases, the incremental increase in such numbers and the locations of such added wales being sufficient to compensate for said transversely differential stretching characteristics of such stabilized fabric, whereby the so knitted and subsequently tensioned and stabilized fabric has substantially equal widths in each of its pattern repeats.

Similarly, the product of this invention is a dimensionally stabilized knitted fabric of predetermined width having a plurality of pattern repeats. Each such repeat is generally of predetermined width and fabric location relative to others thereof. Such fabric has a generally predeterminable transverse stretch distortion characteristic which is greatest along a predetermined longitudinally extending hypothetical reference line. Such fabric has an incremental transverse wale size distortion which generally increases between said reference line and each respective opposed side edge portion of said stabilized fabric relative thereto. Each pattern repeat has that number of wales which is required for incrementally achieving such predetermined respective width of each said pattern repeat in said stabilized fabric pattern repeats that number of wales in each pattern repeat depending upon the relative position of each such respective pattern repeat in said stabilized fabric between said reference line and each of said respective opposed side edge portions. The increase in such numbers of wales as the distances from said reference line increase, and the locations of such added wales, is generally sufficient to compensate for said transversely differential stretching characteristics of said fabric. Thus, the so knitted fabric when subsequently tensioned and stabilized has substantially the desired predetermined widths in each of its pattern repeats.

In addition to the technique of sliver knitting a differentially knitted fabric, as described and illustrated above, it will be recognized by those skilled in the art that other methods of knitting various pile fabrics may be effectively used. Such methods include those used to produce warp knitted fabrics, such as tricot, raschel, and the like. Also, additional weft knitting processes can be employed, such as are commonly used to product pile fabrics.

Although the teachings of our invention have herein been discussed with reference to specific theories and embodiments, it is to be understood that these are by way of illustration only and that others may wish to utilize our invention in different designs or applications.

By the term "pattern repeat" as used herein reference is had primarily to a visual effect as compared to a technical or precise fabric constructional (e.g. stitch placement) fact. For example, in the case of a seemingly pelted fabric, one selected pattern repeat transversely comprises a single animal pelt width at one transverse location when the pelt(s) adjacent such a selected pelt would achieve substantially the same aesthetic appearance with perhaps a technically different stitch pattern arrangement.

The claims are:

1. A method for making a knitted fabric of predetermined width having a plurality of pattern repeats of predeterminable width, said fabric having a generally predeterminable transverse stretch distortion characteristic when dimensionally stabilized, said distortion characteristic being greatest along a predetermined longitudinally extending hypothetical reference line which need not be the same as the longitudinally extending hypothetical center line of said fabric, said method comprising the steps of (A) determining the incremental transverse wale size distortions which will exist in said stabilized fabric between said reference line and each respective opposed side edge portion of said stabilized fabric relative thereto, (B) assigning to each pattern repeat that number of wales which is required for incrementally achieving the desired respective width of each said pattern repeat in said stabilized fabric pattern repeats, depending upon the relative position of each such respective pattern repeat in said stabilized fabric between said reference line and each of said respective opposed side edge portions, (C) programming the control apparatus functionally associated with a knitting machine to knit a knit pile fabric wherein successive patterns on either side of said reference line contain progressively and incrementally respectively increasing numbers of wales as the distance from said reference line increases, the incremental increase in such numbers and the locations of such added wales being sufficient to compensate for said transversely differential stretching characteristics of such stabilized fabric, whereby the so knitted and subsequently tensioned and stabilized fabric has substantially the predetermined widths in each of its pattern repeats.

2. In a method for making a knit fabric of the type which has been dimensionally stabilized by being:

(a) tensioned both transversely and longitudinally to an extent sufficient to expand the length thereof from 0 to about 30% and to the width thereof from about −30% to +30%.

(b) thereafter back coated with a stabilizing coating composition, and (c) then heated to bond said coating composition to said back, said fabric additionally having, (A) from about 8 to 24 wales per inch and from about 17 to 42 courses per inch, (B) a transverse width of from about 36 to 90 inches, (C) the back thereof composed of yarn having a denier ranging from about 150 to 600, and (D) the pile thereof incorporating a plurality of longitudinally extending, transversely repeating patterns, each such pattern incorporating from about 10 wales up to a number of wales not greater than about ⅓ of the total number of wales comprising the transverse width of said fabric, the improvement which comprises varying systematically and incrementally the number of wales in pattern repeats between opposed lateral side edges of said pile fabric, there being at least one such variation transversely such that each said pattern repeat is about equal to all the others of said plurality in transverse width.

3. A method for making a knit pile fabric having a plurality of longitudinally extending transversely repeating patterns, all such patterns having a substantially equal transverse width, said method comprising the steps of:

(A) estimating the amount of excess transverse pattern width by which the pattern(s) not along the opposed side edges of a desired knit pile fabric exceed(s) the pattern width of the patterns adjacent each opposed side edge of said knit pile fabric, each pattern incorporating at least 10 wales transversely and not more than ⅓ of the total number of wales in said fabric, said knit pile fabric having a plurality of substantially equal width longitudinally extending patterns therein, said knit pile fabric being dimensionally stabilized in a tensioned configuration such that the transverse width thereof is established at from about −30% to +30% of the relaxed dimensionally unstabilized width thereof, (B) removing from said patterns, except for those adjacent said opposed side edges that number of wales which substantially equals the value of such excess width.

4. The process of claim 3 where, in determining said removing, one (A) compares successive respective intervening patterns between said side edge patterns, with said side edge patterns and determines the numbers and locations progressively and incrementally of those respective wales which substantially exceed excess widths of said intervening respective pairs of patterns relative to said side edge patterns, and (B) programs the control apparatus functionally associated with a knitting machine to knit a knit pile fabric wherein successive patterns between said side edge patterns contain progressively and incrementally respectively lesser numbers of wales as the distance from said side edge patterns increases towards the regions of maximal wale transverse distortion in said stabilized fabric the decrease in such numbers and the locations of such subtracted wales being sufficient to compensate for the transversely differential stretching characteristics of said fabric, whereby the so knitted fabric when subsequently tensioned and stabilized has substantially equal widths in each of its pattern repeats.

5. A dimensionally stabilized knitted fabric of predetermined width having a plurality of pattern repeats of predetermined width, said fabric having a generally predeterminable transverse stretch distortion characteristic, said distortion characteristic being greatest along a predetermined longitudinally extending hypothetical reference line which need not be the same as the longitudinally extending hypothetical center line of said fabric, said stabilized fabric having an incremental transverse wale size distortion which generally decreases between said reference line and each respective opposed side edge portion of said stabilized fabric relative thereto, each pattern repeat having that number of wales which is required for incrementally achieving such predetermined respective width of each said pattern repeat in said stabilized fabric, that number of wales in each pattern repeat depending upon the relative position of each such respective pattern repeat in said stabilized fabric between said reference line and each of said respective opposed side edge portions, the increase in such numbers of wales as the distances from said reference line increases, and the locations of such added wales, being generally sufficient to compensate for said transversely differential stretching characteristics of said fabric, whereby the so knitted fabric when subsequently tensioned and stabilized has substantially the predetermined widths in each of its pattern repeats.

6. The fabric of claim 5 wherein the total number of pattern repeats transversely ranges from about 8 to 50.

7. The fabric of claim 5 wherein the total number of pattern repeats transversely ranges from about 15 to 35.

8. The fabric of claim 5 wherein the number of wales per inch across said reference line is about 0.5 the number of courses per inch.

9. The fabric of claim 5 wherein the weight ratio of pile fiber to backing yarn ranges from about 2.5:1 to 10:1.

10. The fabric of claim 5 wherein said pile is comprised of fibers extending from about ⅛ to 2 inches in height over said backing.

11. In a knit pile fabric which has been dimensionally stabilized by being:

(a) tensioned both transversely and longitudinally to an extent sufficient to expand the length thereof from 0 to about 30% and to expand the width thereof from about −30% to +30%.

(b) thereafter back coated with a stabilizing coating composition, and (c) then heated to bond said coating composition to said back, said fabric additionally having, (A) from about 8 to 24 wales per inch and from about 17 to 42 courses per inch, (B) a transverse width of from about 36 to 90 inches, (C) the back thereof composed of yarn having a denier ranging from about 150 to 600, and (D) the pile thereof incorporating a plurality of longitudinally extending, transversely repeating patterns, each such pattern incorporating from about 10 wales up to a number of wales not greater than about ⅓ of the total number of wales comprising the transverse width of said fabric, the improvement which comprises incorporating into said fabric systematic, and incremental, transverse variations in the number of wales in pattern repeats between a longitudinally extending reference line and each opposed lateral side edge of said pile fabric, there being at least one such variation, all such variations commencing in a spaced relationship to one another between said reference line and each said opposed lateral side edge, the interrelationship between said variations and said pattern repeats being such that each said pattern repeat is about equal to all the others thereof in transverse width.

* * * * *